US006022211A

United States Patent [19]

Wang

[11] Patent Number: 6,022,211

[45] Date of Patent: Feb. 8, 2000

[54] LIGHTER

[76] Inventor: Zhengge Wang, Unit 2-7051 Ash Crescent, Vancouver, British Columbia, Canada, V6P 3K6

[21] Appl. No.: 09/062,609

[22] Filed: Apr. 20, 1998

[51] Int. Cl.[7] ..... F23D 11/36; F23Q 25/00

[52] U.S. Cl. ..... 431/144; 431/153; 431/255

[58] Field of Search ..... 431/144, 153, 431/277, 255, 263, 310, 142, 146

[56] References Cited

U.S. PATENT DOCUMENTS 5,228,849 7/1993 Frigiere ..... 431/153

5,788,476 8/1998 Sher ..... 431/153

*Primary Examiner*—Carl D. Price

[57] ABSTRACT

A lighter comprising a fuel tank, a tank cover on the fuel tank, a fuel valve mounted on the cover, the fuel valve being operable to release fuel from the fuel tank, a flame adjustment ring which is adjustable for controlling the height of a flame above the fuel valve, a windshield for protecting the flame, an actuating knob of resilient material, a lever which is pivotable in response to actuation of the actuating knob from its locked position for opening the valve, a piezoelectric unit operable by the actuation of the actuating knob for igniting the fuel, and a spring resiliently urging the actuating knob into a locked condition for releasibly retaining the actuating knob in a locked position and thereby preventing the opening of the valve and the actuation of the piezoelectric unit, the actuating knob being resiliently flexible against the action of the spring for releasing the actuating knob from its locked condition.

9 Claims, 6 Drawing Sheets

LIGHTER

BACKGROUND OF THE INVENTION

1. Field of the Invention

The present invention relates to lighters and, more particularly, to piezoelectric lighters for cigarettes and the like.

2. Description of the Related Art

A conventional piezoelectric cigarette lighter has a fuel tank, with a fuel tank cover and a supply of liquid fuel, usually butane, in the tank. A normally-closed fuel valve mounted on the fuel tank cover is operable to allow fuel to escape from the tank, and a piezoelectric unit, operated by actuation of an actuating knob, is employed to ignite the fuel leaving the fuel valve and, thus, to produce a flame, which is protected by a windshield\ extending around the fuel valve and at least a portion of the flame.

Various means have been proposed in the past for releasibly retaining the actuating knob in a locked position in order to prevent accidental actuation and ignition of the lighter and to make the lighter child-resistant.

BRIEF SUMMARY OF THE INVENTION

According to the present invention there is provided a lighter having a cover on a fuel tank, with a fuel valve mounted on the cover, the fuel valve being operable to release fuel from the fuel tank. An actuating member of resilient material is provided with a spring urging the actuating member into a locked condition for releasibly retaining the actuating member in a locked position. A lever, which is pivotable in response to actuation of the actuating member from its locked position for opening the valve and a piezoelectric unit operable the actuation of the actuating member for igniting the fuel, are also provided.

In the preferred embodiment of the invention, the actuating member comprises a top portion, a depending portion and an abutment on the depending portion, and the spring resiliently deflects the depending portion relative to the top portion so as to engage the abutment on the depending portion with a counterabutment in order, thus, to retain the actuating member in the locked position.

BRIEF DESCRIPTION OF THE DRAWINGS

The invention will be more readily understood from the following description of a preferred embodiment given, by way of example, with reference to the accompanying drawings, in which.

DESCRIPTION OF THE PREFERRED EMBODIMENT

Figure 1:
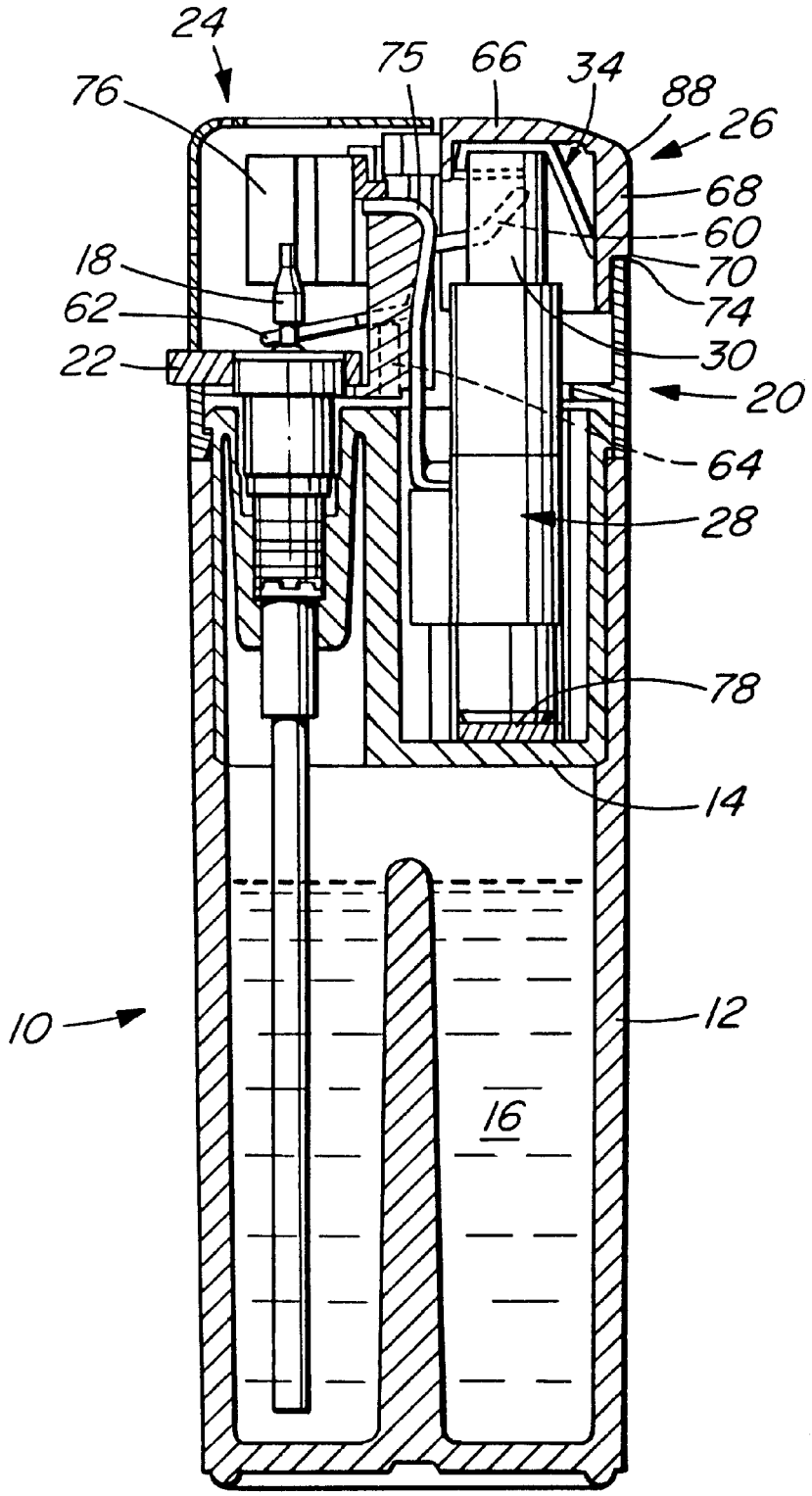
FIGS. 1, 2 and 3 show three views, taken in vertical cross-section through a lighter embodying the present invention, and showing the lighter in a locked condition, an intermediate position and an actuated condition respectively.

In the accompanying drawings, there is shown a piezoelectric lighter indicated generally by reference numeral 10, which has a fuel tank 12, provided with a fuel tank cover 14 and containing a supply 16 of liquid butane fuel.

A conventional normally-closed fuel valve 18 is mounted in a bracket which is in the form of a plastic molding and indicated generally by reference numeral 20, secured in snap-action engagement on the top of the fuel tank cover 14. The fuel valve 18 is provided with a flame adjustment ring 22, by means of which the outflow of fuel through the fuel valve 18, when the fuel valve 18 is open, can be adjustably controlled, in conventional manner.

The lighter 10 is also provided with a windshield, which is indicated by reference numeral 24, and an actuating member which is indicated generally by reference numeral 26, both of which are described in greater detail below.

A piezoelectric unit indicated generally by reference numeral 28, is partially recessed in the fuel tank cover 14, and has at its top an upwardly extending plunger 30 having a top surface 32. A first leaf spring 34 is fitted on the top of the plunger 30.

Figure 7:
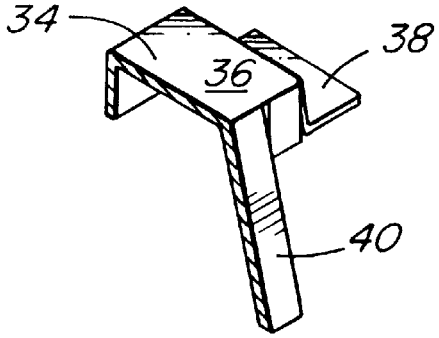
FIG. 7 shows a broken-away view, in perspective, of parts of a leaf spring forming part of the lighter of FIGS. 1 through 3.

More particularly, as shown in FIG. 7, the leaf spring 34 has an intermediate portion 36, which has a pair of oppositely laterally projecting flanges 38 (of which only one is shown in FIG. 7), and a spring arm 40 depending at an inclination from the intermediate portion 36.

Figure 4:
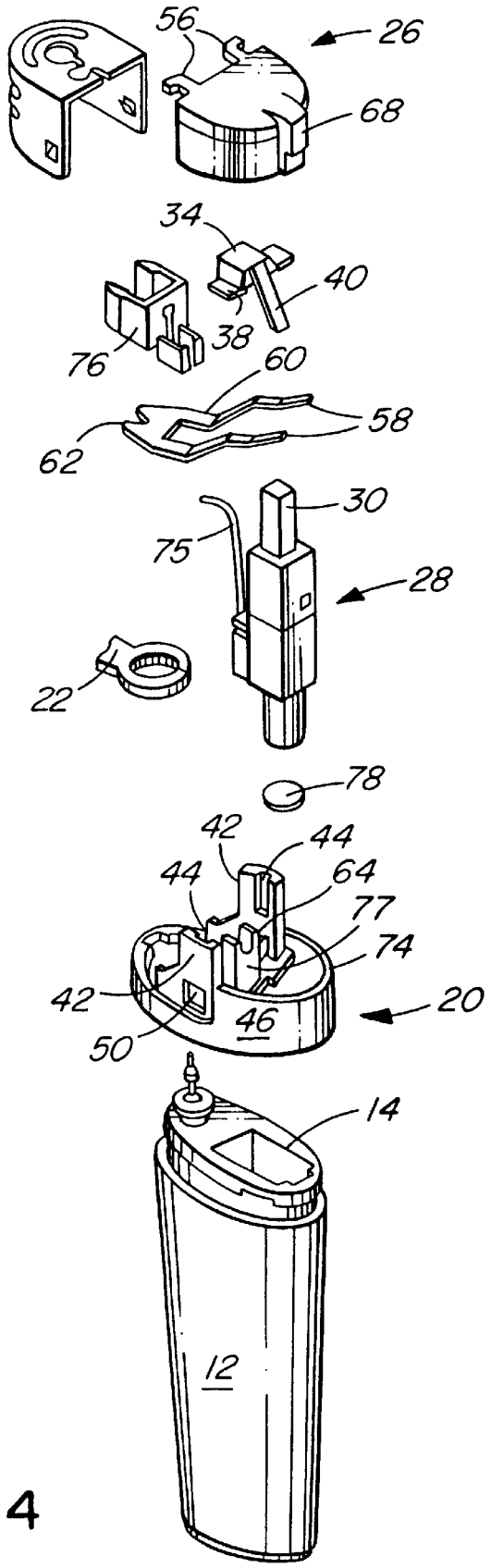
FIG. 4 shows an exploded view, in perspective, of components of the lighter of FIGS. 1 through 3.

The bracket 20, as shown in FIG. 4, is formed with two upstanding arcuately curved posts 42 formed with opposed vertical straight channel-shaped recesses 44 and also a collar 46 extending around an upper portion of the lighter 10.

Figure 8:
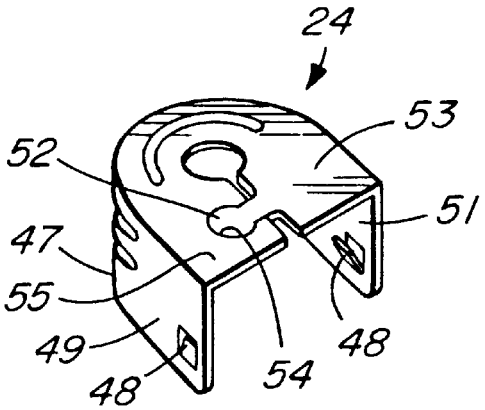
FIG. 8 shows a view in perspective of a windshield forming part of the lighter of FIGS. 1 through 3.
Figure 9:
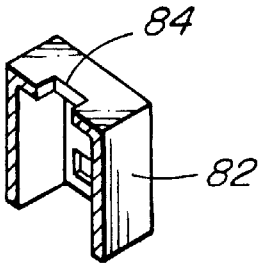
FIG. 9 shows a broken-away view, in perspective, of a sleeve for use with the piezoelectric unit of FIG. 9.
Figure 10:
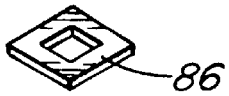
FIG. 10 shows a view in perspective of a square sealing member for use with the piezoelectric unit of FIG. 9.

Referring to FIG. 8, the windshield 24 is formed of one piece of sheet metal with a curved wall 47 extending along and connecting opposite halves 49, 51 of the windshield 24 and a pair of projections in the form of opposed tabs 48 extending inwardly of the opposite halves 49, 51 of the windshield 24. The tabs 48 project into engagement with opposed openings, of which only one is shown in the drawings and which is indicated by reference numeral 50, in opposite sides of the bracket 20. The tabs 48 are retained in engagement with the bracket 20, to thereby secure the windshield 24 to the bracket 20 by interengagement of a lug-shaped projection 52 on one half of the windshield 24 in a correspondingly shaped recess 54 in an opposite half of the windshield 24. More particularly, the top of the windshield 24 includes a pair of top portions 53 and 55 which are separate from one another and which extend towards one another from the top of the curved wall 47, and the lug-shaped projection and the recess 54 form projecting and recessed portions, respectively, of the top portions 53 and 55.

The actuating member 26 is formed, at one side, with a pair of oppositely directed projections 56 (FIG. 4), which slidably engage in the channel-shaped recesses 44 in the posts 42 for guiding the actuating member 26 during vertical displacement to and fro of the knob 26 during the actuation of the lighter 10. During this movement, the laterally projecting flanges 38 of the leaf spring 34 press against arms 58 of a lever in the form of a bifurcated second leaf spring 60, an opposite end 62 of which engages the fuel valve 18 so that the spring 60 is rocked in a vertical direction about a pair of fulcrums 64 on the bracket 20 and, thus, causes the fuel valve 18 to open as the actuating member 26 is depressed.

The actuating member 26 has a top portion 66, a depending finger or portion 68 and an abutment 70, in the form of an abutment shoulder, on the depending portion 68. The depending portion 68 is resiliently deflectable, thanks to a recess 72 between the top of the depending portion 68 and the top portion 66 of the actuating member 26, so that in a normal, locked or inoperative position of the actuating member 26, as shown in FIG. 1, the abutment 70 overlies a top edge 74 of the collar 46. The top edge 74 forms a counterabutment, so that the collar 46 thus prevents the actuating member 26 from being depressed and the actuating member 26 is thereby retained in a position of abutment, in which it is shown in FIG. 1. The depending portion 68 is urged towards this locked position by the action of the spring arm 40 of the leaf spring 34, the intermediate portion 36 of the leaf spring 34 being sandwiched between the top of the piezoelectric unit plunger 30 and the underside of the top portion 66 of the actuating member 26.

The piezoelectric unit 28 has an electrode arm 75, an upper end of which is held in position by a clip 76. The bracket 20 is formed with a central post 77 which extends upwardly from between the two fulcrums 64 into engagement with the clip 76, which is thereby held in position.

Figure 2:
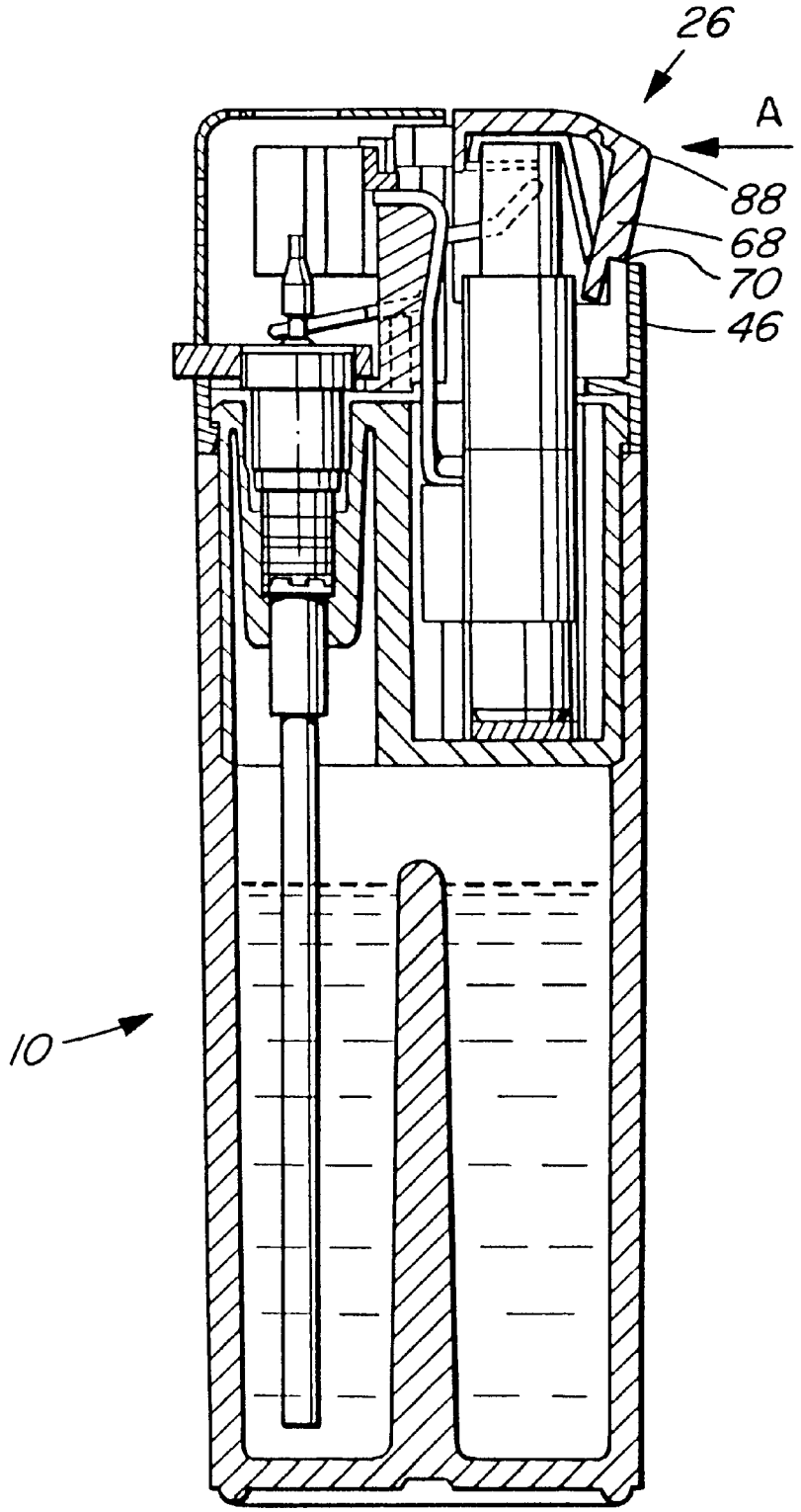
Figure 3:
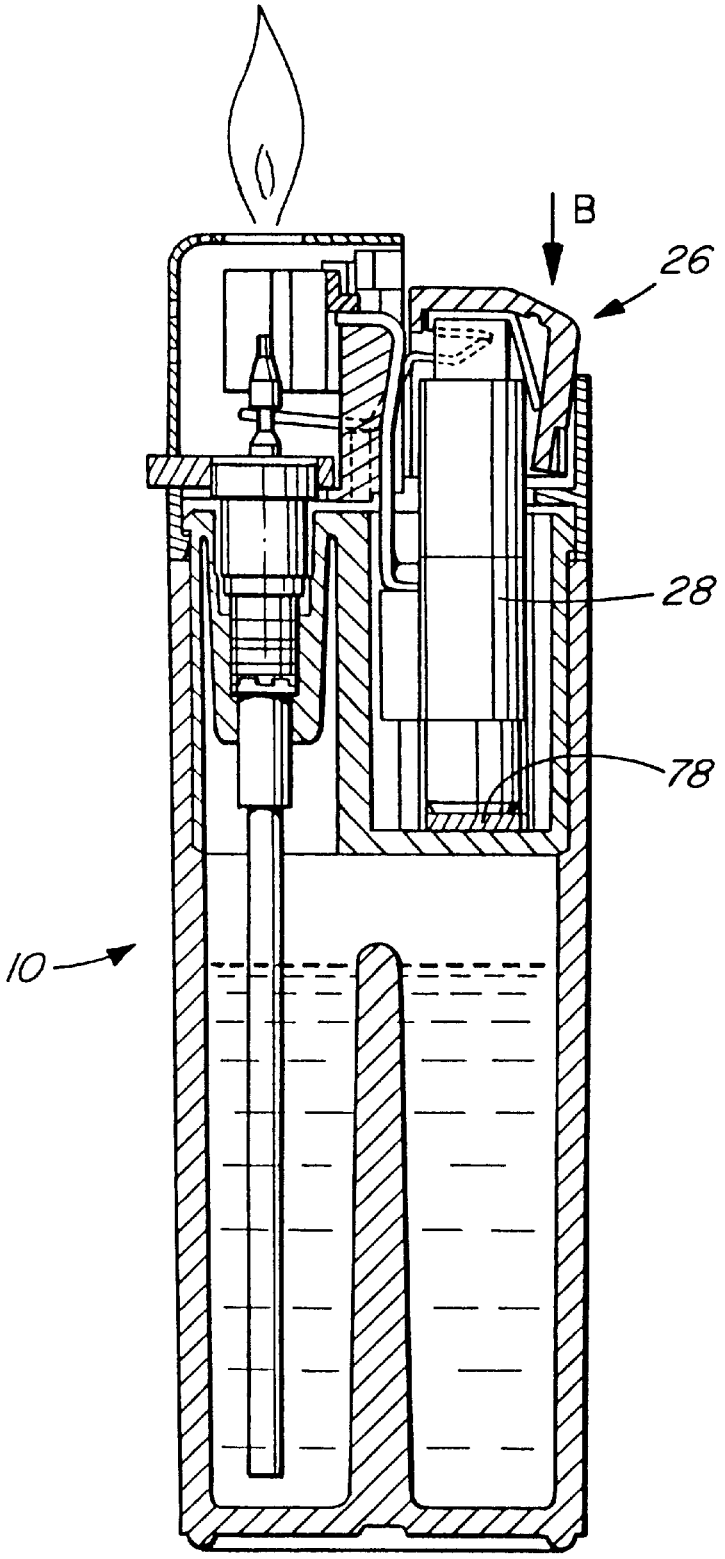

When a protruding corner 88 of the depending portion 68 of the actuating member 26 is pressed by the users thumb, to the left as viewed in FIGS. 1 through 3 and indicated by arrow A in FIG. 2, it is thereby resiliently deflected relative to the top portion 66 of the actuating knob 26, as shown in FIG. 2, so that the abutment 70 is displaced from its abutment with the collar 46 into a released position, thus allowing the actuating member 26 to be depressed by the users thumb from the position shown in FIG. 2 into the position shown in FIG. 3, as indicated by arrow B, and thereby to be slidably displaced from its locked or inoperative position for operating the lighter.

This depression of the actuating member 26 opens the fuel valve 18, by means of the leaf spring 34, as described above and also depresses the plunger 30 of the piezoelectric unit 28, so as to operate the piezoelectric unit 28 to produce a spark across a metal clip 76 extending at opposite side of the fuel valve 18, thus causing ignition of a flame above the fuel valve 18.

The bottom of the piezoelectric unit 28 is seated on a disk 78 of insulating material interposed between the piezoelectric unit 28 and the fuel tank cover 14.

Figure 5A:
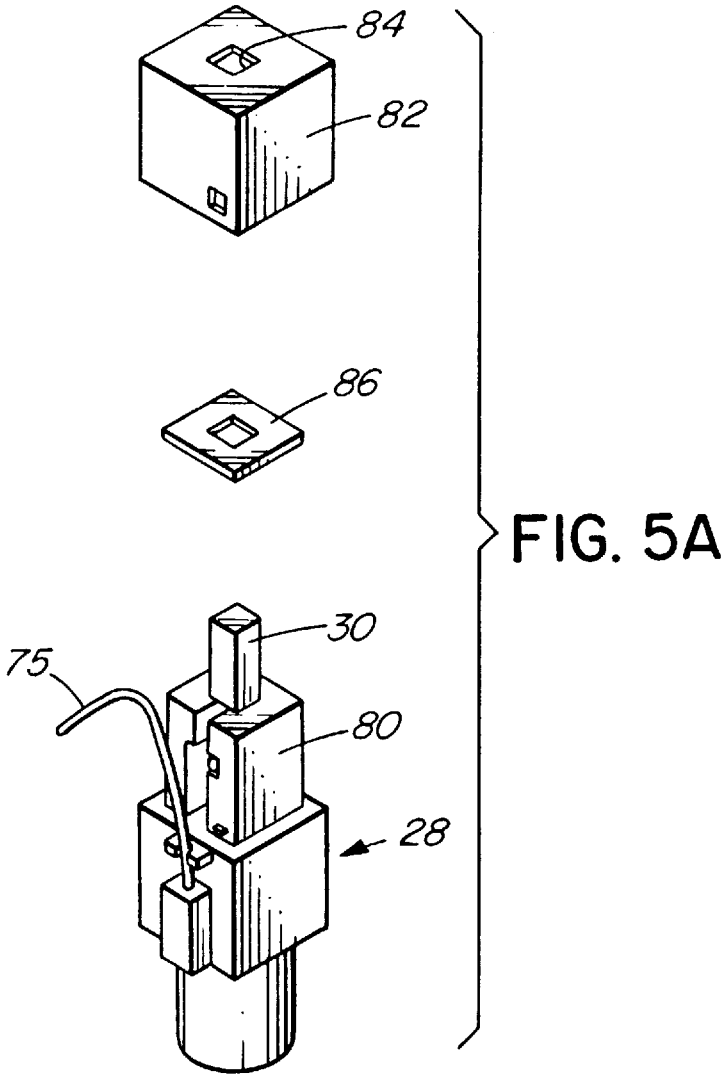
FIG. 5A shows an exploded view, in perspective, of components of lighter of FIGS. 1 through 3.
Figure 5B:
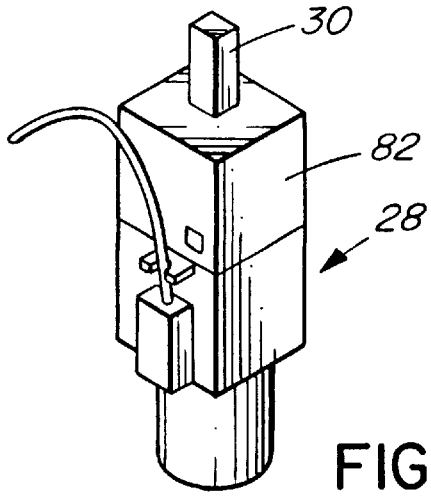
FIG. 5B shows a view, in perspective, of the components of FIG. 5A in an assembled condition.
Figure 6:
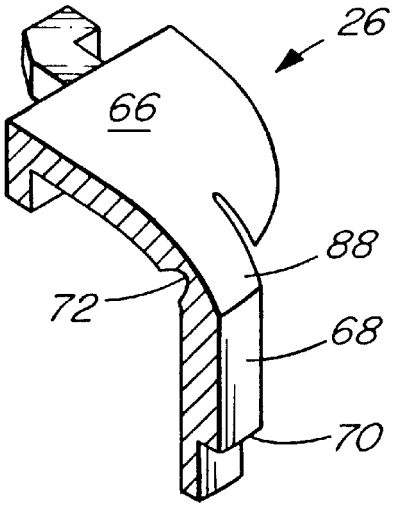
FIG. 6 shows a broken-away view, in perspective, of parts of an actuating member forming part of the lighter of FIGS. 1 through 3.

As shown in FIG. 5A, the piezoelectric unit 28 has a body portion 80 into which the plunger 30 is movable in response to depression of the actuating member 26 for operaing the piezoelectric unit 28 and over which is fitted a sleeve 82 of square cross-section, the sleeve 82 being formed with a square opening 84 through which the plunger 30 extends. A square sealing member 86 is interposed between the top of the intermediate portion 80 of the piezoelectric unit 28 and the top of the sleeve 82 and forms a water-resistant seal in slidable sealing engagement around the plunger 30. All gaps of the piezoelectric unit 28 and its sleeve 82 are carefully sealed by means of a waterproof sealant (not shown) so that, if the lighter 10 is dropped into water, the operation of the piezoelectric unit 28 will not be adversely affected.

Various modifications may be made in the above-described lighter 10 within the scope of the appended claims.

I claim:

1. A lighter, comprising:

a fuel tank;

a tank cover on said fuel tank;

a fuel valve mounted on said cover, said fuel valve being operable to release fuel from said fuel tank;

an actuating member slidably displaceable from a locked position, said actuating member including a retainer portion;

a spring urging said retainer portion towards a retaining position in which said retainer portion retains said actuating member in said locked position, said retainer portion being resiliently deflectable against the action of said spring to release said actuating member for displacement from said locked position;

a lever which is pivotable for opening said valve in response to displacement of said actuating member from said locked position; and a piezoelectric unit operable by the displacement of said actuating member from said locked position for igniting the fuel;

said piezoelectric unit including a plunger, a sleeve surrounding said plunger and a sealing washer interposed between said plunger and said sleeve.

2. A lighter a claimed in claim 1, including a windshield and a bracket on said tank cover, said windshield comprising a windshield body, a pair of tabs projecting from said windshield into engagement with said bracket for retaining said windshield on said bracket, a lug-shaped projection and a correspondingly-shaped recess which are mutually interengaged so as to maintain the engagement of said tabs with said bracket.

3. A lighter as claimed in claim 2, including a bracket on said fuel tank cover, said bracket defining a pair of opposed parallel channel-shaped recesses and said actuating member having oppositely directed projections which engage in said recesses and are slidable along said recesses.

4. A lighter as claimed in claim 1, wherein said spring is a first leaf spring comprising an intermediate portion located between said piezoelectric unit and said actuating member, a pair of flanges projecting laterally from opposite sides of said intermediate portion and a spring arm projecting from said intermediate portion, said arm being resiliently deflectable relative to said intermediate portion and urging said actuating member into its locked condition, and wherein a second leaf spring engages said valve, said second leaf spring being mounted for rocking movement by said flanges for opening aid valve in response to the displacement of said actuating member.

5. A lighter, comprising:

a fuel tank;

a fuel tank cover on said fuel tank;

a supply of fuel in said tank;

a fuel valve mounted on said tank, said fuel valve being operable to release said fuel from said tank;

a bracket on said fuel tank cover;

an actuating member mounted on said bracket, said actuating member being slidably displaceable from an inoperative position for operating said lighter;

a lever mounted on said bracket and pivotable in response to displacement of said actuating member from said inoperative position for opening said valve to release fuel from said tank;

a piezoelectric unit mounted on said fuel tank cover and operable in response to the displacement of said actuating member from its inoperative position for igniting said fuel released by said valve;

a windshield mounted on said bracket and extending around said fuel valve, said windshield having opposite halves, projections extending inwardly of said windshield from said opposite halves into engagement with said bracket, a projecting portion on one of said halves and a recessed portion in the other of said halves, said projecting portion and said recessed portion being mutually engaged so as to maintain the engagement of said projecting portions with said bracket and thereby to secure said windshield to said bracket.

6. A lighter as claimed in claim 5, wherein said windshield is formed in one piece of sheet metal and has a curved wall extending along and connecting said opposite halves and a pair of top portions which are separate from one another and which extend towards one another from said opposite halves, said projecting and recessed portions forming parts of said top portions so that said top portions are secured to one another by the interengagement of said projecting and recessed portions.

7. A lighter, comprising:

a fuel tank;

a fuel tank cover on said fuel tank;

a supply of fuel in said tank;

a fuel valve mounted on said tank, said fuel valve being operable to release said fuel from said tank;

a bracket on said fuel tank cover;

an actuating member mounted on said bracket, said actuating member being slidably displaceable from an inoperative position for operating said lighter;

a lever mounted on said bracket and pivotable in response to displacement of said actuating member from said inoperative position for opening said valve to release fuel from said tank;

a piezoelectric unit mounted on said fuel tank cover and operable in response to the displacement of said actuating member from its inoperative position for igniting said fuel released by said valve;

said piezoelectric unit comprising a body portion, a plunger movable into said body portion in response to actuation of said actuating member, a sleeve fitted onto said body portion, said sleeve having an opening and said plunger extending through said opening, and a seal of resilient material between said sleeve and said body portion in slidable sealing engagement around said plunger.

8. A lighter as claimed in claim 7, wherein said plunger is of square cross-section and said seal and said opening are of a correspondingly square shape.

9. A lighter, comprising:

a fuel tank;

a fuel tank cover on said fuel tank, a supply of fuel in said tank;

a fuel valve mounted on said tank, said fuel valve being operable to release said fuel from said tank;

a bracket on said fuel tank cover;

an actuating member mounted on said bracket, said actuating member being slidably displaceable from an inoperative position for operating said lighter;

a lever mounted on said bracket and pivotable in response to displacement of said actuating member from said inoperative position for opening said valve to release fuel from said tank;

a piezoelectric unit mounted on said fuel tank cover and operable in response to the displacement of said actuating member from its inoperative position for igniting said fuel released by said valve;

a windshield mounted on said bracket and extending around said valve, said windshield having opposite halves, projections extending inwardly of said windshield from said opposite halves into engagement with said bracket, a projecting portion on one of said halves and a recessed portion in the other of said halves, said projecting portion and said recessed portion being mutually engaged so as to maintain the engagement of said projecting portions with said bracket and thereby to secure said windshield to said bracket; and a spring resiliently urging said actuating member into a locked condition for said releasably retaining said actuating member in a locked position and thereby preventing the opening of said valve and the actuation of said piezoelectric unit:

said actuating member being resiliently flexible against the action of said spring for releasing said actuating member from its locked condition; and said piezoelectric unit comprising a body portion, a plunger movable into said body portion in response to actuation of said actuating member, a sleeve fitted onto said body portion, said sleeve having an opening and said plunger extending through said opening, and a seal of resilient material between said sleeve and said body portion in slidable sealing engagement around said plunger.

* * * * *